United States Patent [19]

Helding

[11] 4,233,798

[45] Nov. 18, 1980

[54] BOX CLOSING MACHINE

[76] Inventor: James R. Helding, 8415 Five Mile Rd., Franksville, Wis. 53126

[21] Appl. No.: 62,251

[22] Filed: Jul. 30, 1979

[51] Int. Cl.[3] ..... B65B 57/02; B65B 7/20

[52] U.S. Cl. ..... 53/76; 53/374; 493/177; 493/179

[58] Field of Search ..... 53/76, 374, 375; 93/49 R

[56] References Cited

U.S. PATENT DOCUMENTS

| | | | |
|---|---|---|---|
| 1,815,571 | 7/1931 | Kimball et al. | 53/374 X |
| 3,861,115 | 1/1975 | Peres | 53/76 |

*Primary Examiner*—Travis S. McGehee

*Attorney, Agent, or Firm*—Ralph G. Hohenfeldt

[57] ABSTRACT

A machine for folding the top flaps on a succession of boxes which are advanced on a conveyor belt. A shaft extends across the path of the boxes and has arms journaled on it for rotating and folding the trailing end flap of each box when the shaft is rotated. Torsion springs have one of their ends fastened to the shaft and another of their ends in driving contact relationship with the respective arms. When a box is in a position for one of its end flaps to be folded, limit switches are actuated in succession to cause an electrically operated clutch to turn the shaft one revolution so the arms swing around under the driving influence of the torsion springs and fold and hold the trailing top end flap until the box is advanced to the position where its end flaps are finally restrained by folding and holding its side flaps.

6 Claims, 7 Drawing Figures

BOX CLOSING MACHINE

BACKGROUND OF THE INVENTION

This invention relates to a machine for folding the top end flaps and side flaps of boxes in order to cover and close the boxes.

The new machine is distinguished by its capability for folding the flaps of a box downwardly toward the body of the box without crushing the contents of the box if it is overfilled and its contents bulge out of the top opening of the box. The new machine has features that are particularly advantageous for folding the flaps on boxes which have been overstuffed with fruits or vegetables such as cabbages which are vulnerable to crushing. It is desirable that the flaps be kept under pressure and held down despite overstuffing until the boxes enter the strapping machine.

Insofar as applicant has been able to ascertain, there is no prior art box folding machine available which can fold the flaps of an overstuffed box without exerting so much force on the flaps as to damage the contents of the box nor is there a machine which will properly hold the flaps in place if the conveyor on which the boxes are advanced through the machine stops while the flap folding operation is in progress.

SUMMARY OF THE INVENTION

A principal object of the invention is to provide a box closing machine which will fold the top flaps of a box, particularly one that has been overfilled with vegetables, without exerting undue pressure on the vegetables.

Another object is to provide a machine which will not only fold the flaps of a box and close it, but will hold the flaps until folding is complete and the box is prepared to enter a strapping machine even though the conveyor which transports the boxes through the machine stops while the flaps on a box are experiencing the folding operation.

Still another object is to provide a machine which is capable of folding box top flaps at an unusually high rate.

Briefly stated, the machine includes a conveyor for transporting boxes through it. The boxes are conveyed into the machine with their flaps upstanding. A box encounters substantially conventional means for folding the leading top end flap rearwardly over the contents of the box. As the box advances, a new mechanism, to be described herein, engages the trailing end top flap and folds it forwardly toward the leading flap. The mechanism comprises a shaft which extends across the linear path of the boxes and is driven intermittently through a clutch which only engages its input to its output when the box strikes a limit switch. This occurs before the side flaps are folded. In the preferred embodiment, a pair of curved arms are journaled on the shaft. A torsion spring has one end fastened to the shaft and its other end in contact relationship with the curved arm so that when the shaft is driven the arm will be driven under the influence of the torsion spring. The arm swings around to make contact with and fold the trailing flap forwardly. If the conveyed boxes happen to stop during this time or if the overstuffed contents resist full free rotation of the arm, the torsion spring becomes loaded and maintains the arm in contact with the trailing flap until the box has been advanced far enough for the side flaps to be folded over the trailing end flap.

How the foregoing and other more specific objects of the invention are achieved will be evident in the more detailed description of a preferred embodiment of the invention which will now be set forth in reference to the drawings.

DESCRIPTION OF A PREFERRED EMBODIMENT

Figure 1:
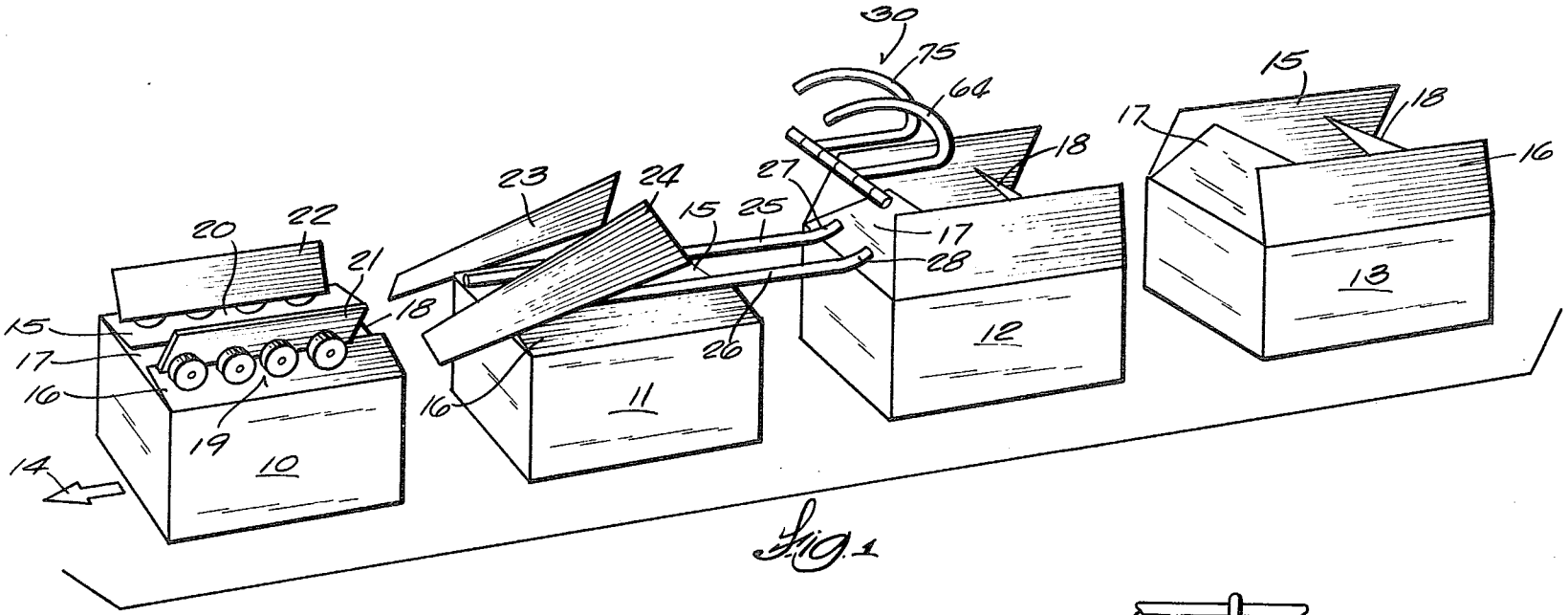
FIG. 1 is a diagram showing a succession of boxes at various stages of the top flap folding operations while progressing through the new machine.

The various stages of the flap folding operation will be outlined first in reference to FIG. 1 and then the details of the new mechanism will be described. In FIG. 1, a succession of boxes are shown at various stages of advancement to the flap folding machine. Four boxes 10–13 are illustrated. The boxes are advancing on a conveyor in the direction indicated by the arrow 14. The boxes arrive at the input end of the machine in the condition of box 13 which has its side flaps 15 and 16 and its leading and trailing end flaps 17 and 18 partially upstanding. The flaps are integral and hinged to the side walls which form the body of the box.

Box 10 has advanced sufficiently in the machine for its side flaps 15 and 16 and its leading and trailing end flaps 17 and 18 to be fully folded such that the box is ready for being advanced to a strapping machine which is not shown and wherein the boxes are strapped or banded to keep them closed. While box 10 is in readiness for being advanced to the strapping machine, the top flaps of this box are held in folded condition under pressure applied by laterally spaced apart series of rollers 19 and 20 which are journaled for rotation on a pair of stationary plates 21 and 22, respectively.

Before the box reached the illustrated location of box 10, it passed through the location in which box 11 is illustrated. At this location the box encounters a pair of stationary and angulated deflector blades 23 and 24 which diverge from each other at their right end. Blades 23 and 24 are angulated in a manner which results in their pressing on side flaps 15 and 16 so that these flaps fold inwardly toward each other and over the end flaps 17 and 18 which have been folded in a previous location before the box had been advanced to the location wherein box 11 presently resides in FIG. 1.

The first thing that an incoming box, such as box 12, encounters in the machine, are a pair of parallel downwardly spring-biased rods 25 and 26 which have curved tips 27 and 28. The box and its leading top end flap 17 is contacted by curved rod tips 27 and 28 to cause end flap 17 to fold rearwardly and downwardly onto the contents of the box if the contents are bulging upwardly from the box although the end flap will be pushed to a full horizontal position if the box is not overfilled.

Before the box which is shown in the location of box 12 advances as far as box 11, the trailing top flap 18 of box 12 will pass under an arm assembly which is generally designated by the reference numeral 30. As trailing top end flap 18 passes under assembly 30, the arm assembly is rotated and is operative to fold and press trailing end flap 18 downwardly toward the contents of the box. As will be shown, arm assembly 30 holds trailing end flap 18 down or in a folded condition while the box advances under the rods 25 and 26 and through the side flap folding members 23 and 24. The structural features of arm assembly 30 and its operating mechanism will be described in detail shortly hereinafter as these are novel aspects of the machine.

Figure 2:
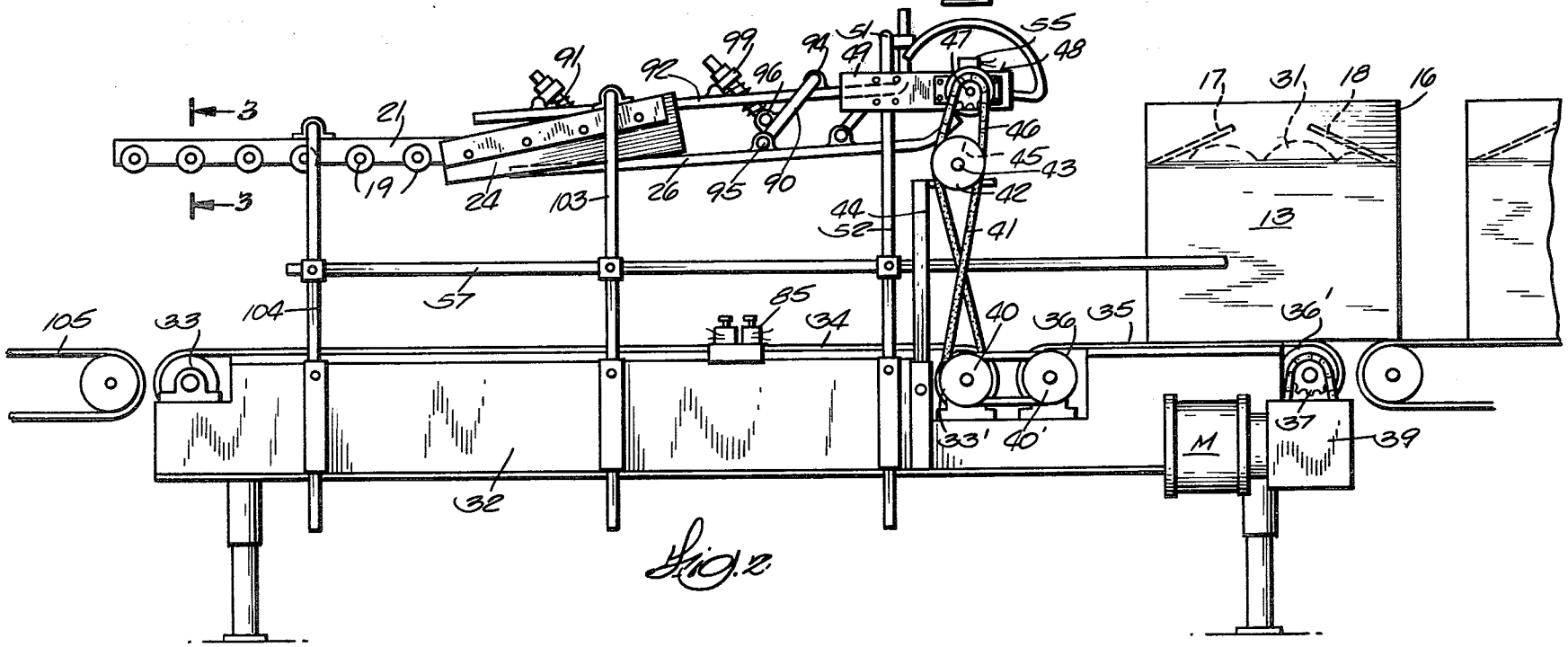
FIG. 2 is a side elevation of the machine.

Refer now to FIG. 2 where a side elevation of the flap folding and holding machine is shown. Filled boxes, such as the one marked 13, are conveyed into the input end of the machine and advance from right to left in this illustration. Box 13 may be filled or overfilled with vegetables such as cabbages 31 which are indicated by curved dashed lines and are seen to be bulging out of the top of the box.

The machine in FIG. 2 comprises a pair of spaced apart parallel beams such as the one marked 32 which stand on legs. A pair of rollers 33 and 33' are journaled for rotation on the beams and a closed loop conveyor belt 34 runs on the rollers. Boxes such as 13 are conveyed through the machine on conveyor belt 34. There is another short closed loop conveyor belt 35 at the entrance or input end of the machine. This belt runs on rollers 36 and 36' which are journaled on beam 32. Roller 36' for conveyor belt 35 has a sprocket 37 on its shaft which is driven by a closed loop chain 38 which runs out of a speed reducer box 39. The speed reducer is driven by an electric motor marked M. Conveyor belt 35 drives conveyor belt 34 through the agency of a pair of pulleys 40 and 40' on which there is a closed loop drive belt. It will be evident that as the upper lengths of conveyor belts 35 and 34 translate to the left they will transport boxes through the machine.

Figure 4:
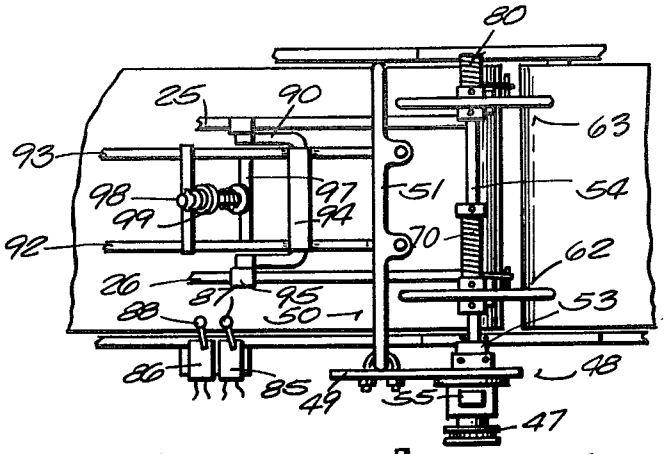
FIG. 4 is a partial plan view of the machine which is depicted in FIG. 2.

Behind pulley 40 which is fixed on the shaft of roller 33' there is another pulley which drives a crisscrossed belt 41. Belt 41 drives a pulley 42 on a shaft 43 which is journaled for rotation in a pillow block on a bracket 44. A sprocket 45 is fastened to shaft 43 behind pulley 42. Sprocket 45 drives a chain 46 which engages another sprocket 47. As can be seen in FIG. 4, sprocket 47 is the power input means to an electrically operated clutch which is generally designated by the reference numeral 48. Clutch 48 is supported from a bracket 49 which is clamped to a frame member 50. Frame member 50 is essentially an inverted U-shaped tube which provides a horizontal part 51 and vertical parts such as the one marked 52 in FIG. 2.

Returning to FIG. 4, clutch 48 has rotatable power output means, essentially a collar 53 which is fastened to a shaft 54. Shaft 54 extends laterally in relation to the longitudinal path of travel of the boxes through the machine and it is spaced from the conveyor belts at a distance which is greater than the height of any box which the machine is adjusted to convey through it. Clutch 48 has a solenoid operator 55 which responds to being energized intermittently by coupling the input means of the clutch to its output means to effectuate rotation of shaft 54.

In a commercial embodiment of the invention, well-known Warner spring type of clutch 48 is used. This clutch is characterized by its power output means being normally locked against rotation and by responding to energization of its solenoid operator 55 by driving shaft 54 through one revolution and then resetting to its locked position in readiness for responding to the next energization of the solenoid. These properties of the clutch are utilized in the preferred embodiment of the invention which is illustrated and described herein.

Figure 6:
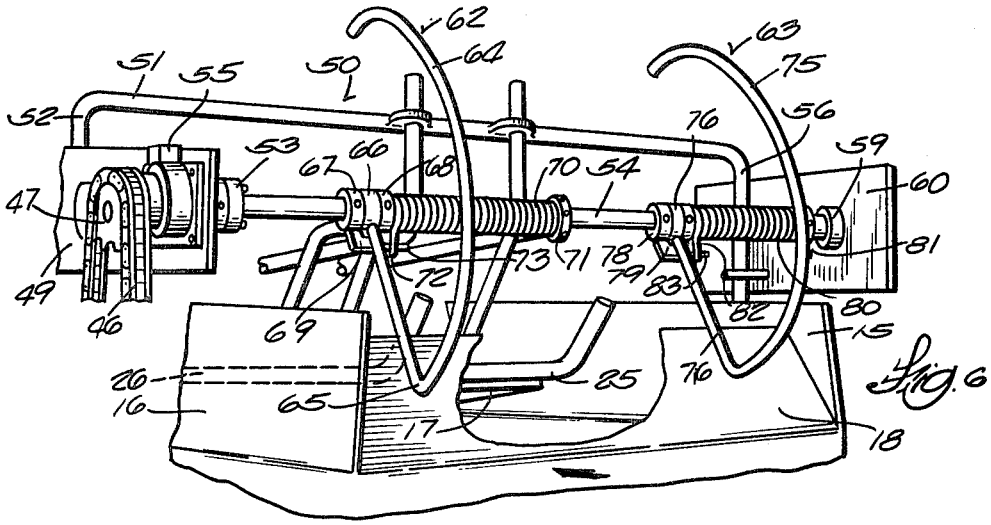
FIG. 6 is a perspective view of the box input end of the machine, with some parts shown fragmentarily and other parts omitted, the new mechanism being in a condition where it is about to initiate folding of the trailing top flap of a box.

As can be seen in FIG. 6, shaft 54 is journaled in a bearing 59 which is supported by a bracket plate 60 that is clamped to the vertical part 61 of frame member 50.

Figure 5:
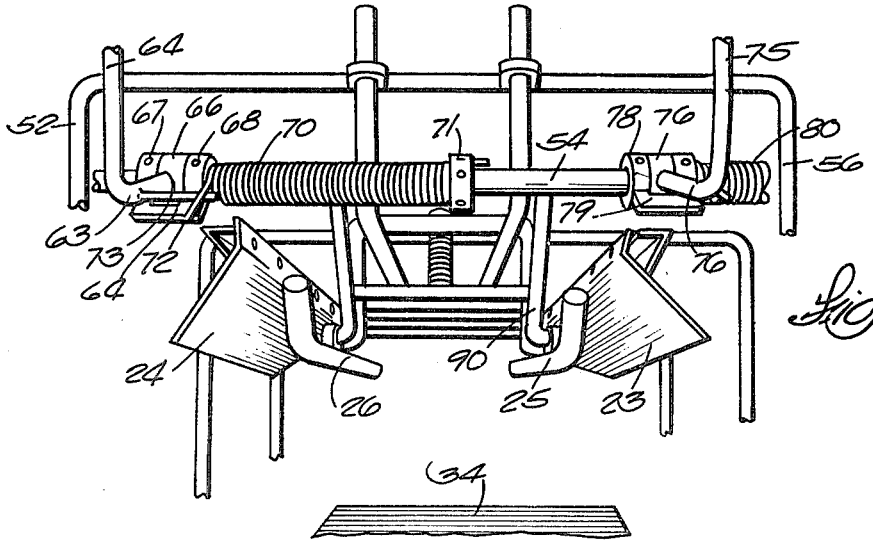
FIG. 5 is a front elevation or box input end of the machine with some parts shown fragmentarily and other parts omitted.

The arms which are operative to fold the trailing top flap 18 of a box will now be discussed in greater detail. The arm assembly was discussed briefly earlier in connection with FIG. 1 where the assembly is designated generally by the numeral 30. Referring to FIG. 6 now, one may see that the arm assembly comprises two individual arms which are generally designated by the numerals 62 and 63. Both arms are constructed and function similarly so arm 62 will be described in the greatest detail. In this embodiment arm 62 comprises a tube or rod formed with a curved portion 64 and a straight radially extending portion 65. Curved portion 64 is generally concentric with the axis of shaft 54 and is almost semi-circular. Radially extending part 65 of the arm is fastened in a bushing 66 to thereby journal the arm for rotation on shaft 54. A pair of collars 67 and 68 are clamped to shaft 54 on axially opposite sides of bushing 66 to prevent the bushing and arm from shifting axially. The bushings are bridged by a rigid stop plate 69 which is fastened to each of them. Radial part 65 of the arm normally rest against stop 69. Rotational force is transmitted from shaft 54 to arm 62 with a torsion spring 70 that is loosely wrapped around shaft 54. One end of torsion spring 70 is secured in a collar 71 which is clamped to shaft 54. The other end of spring 70 terminates in a radially extending tang 72 which is in contact relationship with a pin 73 which projects from the radially extending portion 65 of the arm. The details of this spring drive can be seen more clearly in FIG. 5. It will be evident that if shaft 54 rotates clockwise as viewed from the left end of the shaft in FIG. 6, spring 70 will be loaded torsionally and will thereby transmit driving force to arm 62 as a result of the tang 72 being in contact with pin 73 which extends from the arm. It will also be evident that if arm 62 encounters an impediment to rotation when shaft 54 is turning, torsion spring 70 will become additionally loaded. In other words, the arm 62 can yield or stand still while a torsional force is being applied to it which tends to continue its rotation in the original direction. Thus, even though an arm is stopped, shaft 54 is allowed to make a full revolution and is then locked against rotation due to clutch action while the arms are biased by the torsion springs for completing any necessary part of their revolution.

Arm 63 functions similarly and comprises a curved portion 75, a radially extending portion 76 fastened to a bushing 77 which is journaled on shaft 54. There are collars such as the one marked 78 on each side of the bushing and they carry a stop plate 79. This arm is associated with another torsion spring 80 which has one end clamped to shaft 54 with a collar 81 and which terminates in a tang 82 that reacts against a pin 83 extending from radial arm portion 76 as can be seen in FIG. 6.

In FIGS. 2 and 4 arms 62 and 63 are in their home position wherein the output of clutch 53 and, hence, shaft 54 are locked against rotation. A box 13 is about to be conveyed into the input end of the machine in FIG. 2. The boxes advance on belt 34 between side rails, one of which is marked 57 and is visible in FIG. 2. In FIG. 6, the box had been advanced by the conveyor to a position wherein leading top end flap 17 has been folded rearwardly and is being restrained in folded condition by the pair of ski-shaped spring biased rods 25 and 26 which were mentioned briefly in the general description which referred to FIG. 1 and which will be discussed more completely later. Top side flaps 15 and 16 of the box are not yet folded inwardly which means that the inclined side flap folding plates 23 and 24 have not as yet acted on the side flaps.

Figure 3:
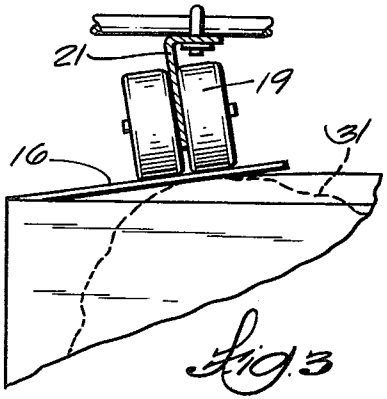
FIG. 3 is a partial vertical section taken on a line corresponding with 3—3 in FIG. 2.

In FIG. 6, arms 62 and 63 are undergoing rotation which means that solenoid 55 of clutch 48 has been energized and the output means 53 of the clutch is unlocked so that shaft 54 is being turned under the driving influence of chain 46. Activation of the clutch has occurred as a result of the box having reached a predetermined position along conveyor belt 34 where the box is ready to have its trailing flap 18 folded inwardly and forwardly by the arm mechanism. When the box reaches this position it actuates the first limit switch 85 of two limit switches, the other of which is marked 86 and both of which are shown in FIGS. 2 and 3 at an edge of conveyor belt 34. Limit switch 85 has a roller arm 87 and limit switch 86 has a roller arm 88. These roller arms are in the travel path of the box so they can be deflected out of the way as the box translates on the conveyor belt 35. When the first limit switch 85 is actuated, solenoid 55 becomes energized and clutch 48 responds by unlocking. This results in shaft 54 turning one full revolution and then becoming stopped or locked. While the shaft is rotating, arms 62 and 63 are being driven rotationally by force derived through torsion springs 70 and 80. When the box advances a little more on conveyor belt 34, the box actuates the second limit switch 86 which deenergizes solenoid 55 of clutch 48. Normal operation is for arms 62 and 63 to make one complete revolution such that their curved portions 64 and 75, respectively, will apply pressure on trailing flap 18 to fold it and hold it down as the box is advancing on the conveyor. When the particular box is out of the way, the arms simply complete a revolution and return to their home position as in FIG. 2. If the conveyance of a succession of boxes stops while a box is having its trailing end flap folded, which might be the case, for example, if the strapping machine is unable to take boxes rapidly enough, arm 62 and 63 remain spring loaded for holding the trailing flap 18 down as long as the box is stopped. Then when the boxes begin to advance again, the trailing end flap remains restrained by the arms until this flap is ultimately restrained by the side flaps 15 and 16 becoming folded over both end flaps 17 and 18. It will be evident that the arms 62 and 63 can always yield to accommodate for a box being significantly overfilled.

Figure 7:
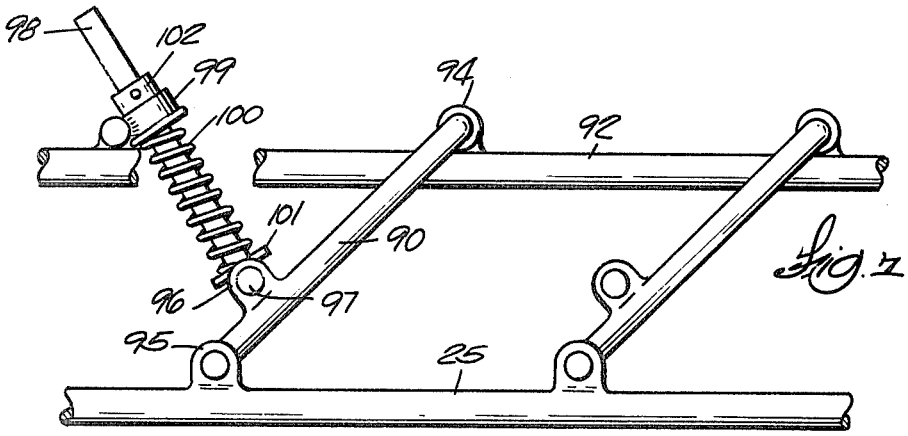
FIG. 7 is a fragmentary side elevation view of the machine component which folds down the leading top flap of a box as it advances into the machine for having its leading and trailing top flaps and its top side flaps folded over the end flaps in that order.

As indicated earlier, the leading flap 17 is folded first and held down by a pair of ski-shaped spring biased rods 25 and 26 until the trailing end flap 18 is folded after which the side flaps 15 and 16 are folded by angulated plates 23 and 24. Referring to FIGS. 2 and 4, one may see that rods 25 and 26 are pivotally mounted on inverted U-shaped member or clevises such as those marked 90 and 91 which are in turn pivotally supported on fixed bars 92 and 93. FIG. 7 shows the details of how one of the ski-shaped rods 25 is mounted. Clevis 90 pivots in a tubular bearing or sleeve 94 which bridge across stationary bars 92 and 93. The free ends of the clevis extend laterally and are journaled in bushings 95 which are welded to rods 25 and 26, respectively. There are lugs 96 on the clevis in which a cross shaft 97 is fixed. A rod 98 is pivotally connected at one end to fixed cross shaft 97. Collars such as the one marked 99 are welded onto bars 92 and 93 through which rod 98 can slide. A spring 100 is interposed between collar 99 and a washer 101 and there is a stop collar 102 fixed on rod 98 to provide for spring compression adjustment and to prevent clevis 90 and ski-shaped rod 25 from falling away. It will be self-evident that if a box of sufficient height passes under ski-shaped rods 25 and 26, spring 100 will yield to accommodate the height of the box and rod 25 and its counterpart 26 will maintain pressure on the end flaps until the side flaps are folded over them.

As is evident in FIG. 2, as the box progresses on the conveyor belt under rods 25 and 26, its side flaps are subsequently folded inwardly by angulated stationary folding plates 23 and 24 which now overlay both end flaps. As can be seen in FIG. 2, folding plates 23 and 24 are supported on opposite legs of a U-shaped frame member 103.

When the box passes from under side flap folding plates 23 and 24 all of its flaps are restrained in folded condition by the series of rollers 19 which are mounted on a support plate 21 that is supported by a frame member 104. Conveyor belt 34 then causes the box to be transported to an adjacent conveyor belt 105 which is at the input end of the strapping machine.

Although a preferred embodiment of the improved box top folding machine has been described in detail, such description is intended to be illustrative rather than limiting, for the invention may be variously embodied and is to be limited only by interpretation of the claims which follow.

I claim:

1. A machine for folding and holding the leading and trailing top end flaps and side flaps of a box over the body of the box, said machine comprising:

power driven conveyor means for conveying a succession of boxes along a predetermined path into and through the machine, a shaft extending laterally in relation to said path and spaced from said conveyor means, clutch means having power input means for being continuously driven and power output means operatively coupled to said shaft, said clutch means having operating means operative to couple and uncouple said power input means to and from said output means, respectively, means responding to a box reaching a predetermined position on said conveyor means by causing said clutch operating means to couple said input to said output means for said shaft to make one revolution and then to uncouple said means, arm means journaled on said shaft and extending generally radially outwardly from the shaft, said arm means being subject to rotation for applying a closing force to the trailing flap of the box when the box reaches said predetermined position, spring means interposed between said shaft and said arm means for driving said arm means rotationally to apply said closing force to said trailing flap when said shaft is rotating and for enabling said arm means to yield and limit the force on said flap.

2. The machine defined in claim 1 wherein said spring means is comprised of a torsion spring having one end fastened to said shaft and its other end arranged for reacting against said arm means.

3. The machine defined in claim 1 including stop means fastened to said shaft and disposed in the rotational path of said arm means for preventing free rotation of said arm means in one rotational direction while permitting said arm means to yield against the force of said spring in the opposite direction.

4. The machine defined in claim 2 including stop means fastened to said shaft and disposed in the rotational path of said arm means for preventing free rotation of said arm means in one rotational direction while permitting said arm means to yield against the force of said spring in the opposite direction.

5. The machine defined in any of claims 1, 2, 3 or 4 wherein said arm means comprise a curved arm member generally concentric to said shaft and rotatable in a plane to which said shaft axis is substantially perpendicular, and means for supporting said member at sufficient radial distance from said shaft for said curved arm member to engage said trailing flap.

6. A machine for folding the leading and trailing top end flaps and side flaps of a box over the body of the box without damaging the contents even if the box is overfilled, said machine comprising:

power driven conveyor means for conveying a succession of boxes forwardly along a predetermined path into and through said machine, first resilient means for engaging and folding the leading flap of a box rearwardly and for temporarily holding said leading flap in a folded condition as said box advances forwardly, second folding means operative to fold said side flaps inwardly toward each other and over said end flaps as said box continues to advance forwardly, and third means operative to fold said trailing end flap forwardly immediately before said side flaps are folded inwardly, said third means including:

a shaft extending laterally in relation to said path and spaced from said conveyor means, clutch means having power input means for being continuously driven and power output means operatively coupled to said shaft and clutch operating means operative to couple and uncouple said input means to and from said output means, respectively, arm means journaled for rotation on said shaft, said arm means having a curved portion generally concentric to and extending radially away from said shaft for rotating in a plane to which said shaft axis is substantially perpendicular, said curved portion being rotatable to engage and fold said trailing flap forwardly, torsion spring means surrounding said shaft and having one end fastened to said shaft and an opposite end in contact relationship with said arm means for rotating said arm means in one direction in response to rotation of said shaft and for permitting said arm to yield and load said spring while still holding said trailing flap if said arm is resisted by the contents of an overfilled box or if advancement of said box is interrupted, limit switch means effective when said box has advanced forwardly enough for said leading end flap to be folded but not far enough for said side flaps to be folded to cause said clutch operating means to engage said clutch input means to said output means for said shaft to rotate one revolution to thereby drive said arm means through said torsion spring means for folding and holding said trailing flap until said side flaps are folded by said second folding means.

* * * * *